US008650034B2

(12) United States Patent
Yamanaka

(10) Patent No.: US 8,650,034 B2
(45) Date of Patent: Feb. 11, 2014

(54) SPEECH PROCESSING DEVICE, SPEECH PROCESSING METHOD, AND COMPUTER PROGRAM PRODUCT FOR SPEECH PROCESSING

(75) Inventor: Noriko Yamanaka, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 146 days.

(21) Appl. No.: 13/208,464

(22) Filed: Aug. 12, 2011

(65) Prior Publication Data

US 2012/0029909 A1 Feb. 2, 2012

Related U.S. Application Data

(63) Continuation of application No. PCT/JP2009/068244, filed on Oct. 23, 2010.

(30) Foreign Application Priority Data

Feb. 16, 2009 (JP) ..... 2009-033030

(51) Int. Cl.
*G10L 13/00* (2006.01)
*G10L 13/08* (2013.01)

(52) U.S. Cl.
USPC ..... 704/260; 704/258

(58) Field of Classification Search
USPC ..... 704/258–269
See application file for complete search history.

(56) References Cited

U.S. PATENT DOCUMENTS 6,038,533 A * 3/2000 Buchsbaum et al. ..... 704/260
6,182,040 B1 * 1/2001 Monaco ..... 704/260
6,823,311 B2 * 11/2004 Tetsumoto ..... 704/270.1
7,313,524 B1 12/2007 Minamino
7,454,340 B2 11/2008 Sakai et al.
7,640,164 B2 12/2009 Sasaki et al.
2001/0021907 A1 * 9/2001 Shimakawa et al. ..... 704/260
2007/0016421 A1 * 1/2007 Nurminen et al. ..... 704/260
2008/0183473 A1 * 7/2008 Nagano et al. ..... 704/258

(Continued)

FOREIGN PATENT DOCUMENTS

JP 11-288298 10/1999
JP 2001-154685 6/2001

(Continued)

OTHER PUBLICATIONS

Japanese Office Action for Japanese Patent Application No. 2009-033030 mailed on Jul. 16, 2013.

(Continued)

*Primary Examiner* — Samuel G Neway
(74) *Attorney, Agent, or Firm* — Turocy & Watson, LLP

(57) ABSTRACT

According to one embodiment, a speech processing device includes an utterance error occurrence determination information storage unit that stores utterance error occurrence determination information; a related word information storage unit that stores related word information including words; an utterance error occurrence determining unit that compares each of the divided words with the condition, gives the error pattern to the word corresponding to the condition, and determines that the word which does not correspond to the condition does not cause the utterance error; and a phoneme string generating unit that generates a phoneme string of the utterance error. The one of the error patterns associated with one of the conditions is the speech error, the utterance error occurrence determining unit further gives an incorrectly spoken word from the related word information, and the phoneme string generating unit generates a phoneme string of the incorrectly spoken word.

19 Claims, 20 Drawing Sheets

(56) References Cited

U.S. PATENT DOCUMENTS

| | | | | |
|---|---|---|---|---|
| 2010/0125459 | A1* | 5/2010 | Itoh et al. | 704/260 |
| 2010/0250254 | A1* | 9/2010 | Mizutani | 704/260 |
| 2012/0029909 | A1* | 2/2012 | Yamanaka | 704/9 |

FOREIGN PATENT DOCUMENTS

| | | |
|---|---|---|
| JP | 2002-268663 | 9/2002 |
| JP | 2002-311979 | 10/2002 |
| JP | 2003-208196 | 7/2003 |
| JP | 2004-037910 | 2/2004 |
| JP | 2004-118004 | 4/2004 |
| JP | 2005-084102 | 3/2005 |
| JP | 2005-293095 | 10/2005 |
| JP | 2006-017819 | 1/2006 |
| JP | 2008-185805 | 8/2008 |
| WO | 2008056590 A1 | 5/2008 |

OTHER PUBLICATIONS

International Search Report for International Application No. PCT/JP2009/068244 mailed on Feb. 2, 2010.

Written Opinion for International Application No. PCT/JP2009/068244.

Hidenori Usuki, et al., "Hayakuchi Kotoba no Iiayamari to Iiyodomi no Seishitsu", IEICE, Technical Report, Jan. 20, 1995, vol. 94, No. 447, pp. 1-6.

* cited by examiner

FIG.2A

| CONDITION OF HEADLINE | CONDITION OF PART OF SPEECH | OPERATION |
|---|---|---|
| ⋮ | | |
| shusha | SAHEN NOUN | PAUSE FROM BEGINNING OF WORD |
| akusesibiriti | NOUN | RESTATEMENT AFTER THIRD SYLLABLE |
| * | CONJUNCTION | RESTATEMENT AFTER UTTERANCE |
| ⋮ | | |

FIG.2B

| CONDITION OF HEADLINE | CONDITION OF PART OF SPEECH | OPERATION |
|---|---|---|
| ⋮ | | |
| accessibility | noun | RESTATEMENT AFTER THIRD SYLLABLE |
| * | conjunction | RESTATEMENT AFTER UTTERANCE |
| ⋮ | | |

| | |
|---|---|
| INPUT STATEMENT | (HOWEVER, IT IS NEEDED TO CHOOSE THE IMPLEMENTING METHOD AFTER CONSIDERING ACCESSIBILITY.) SIKASI, AKUSESIBIRITIO/KOURYOSITE, ZITUGENHOUHOUO/ SHUSHASURU/HITUYOUGAARU. |
| PHONEME STRING | SIKASI, SIKASI, AKUSE, AKUSESIBIRITIO/KOURYOSITE, ZITUGENHOUHOUO/<pause>/SHUSHASURU/HITUYOUGAARU. |

FIG.6

| CONDITION OF HEADLINE | CONDITION OF PART OF SPEECH | OPERATION |
|---|---|---|
| ⋮ | | |
| shusha | SAHEN NOUN | PAUSE FROM BEGINNING OF WORD |
| akusesibiriti | NOUN | RESTATEMENT AFTER THIRD SYLLABLE |
| kouryo | IRREGULAR NOUN | WORD IS SELECTED FROM SYNONYM AT RANDOM AND IS INCORRECTLY SPOKEN, WORD IS CORRECTED AFTER UTTERANCE |
| * | CONJUNCTION | RESTATEMENT AFTER UTTERANCE |
| ⋮ | | |

FIG.7A

| | |
|---|---|
| ⋮ | |
| meiyo | eiyo, tegara/omei |
| kouryo | kousatu, kanan, hairyo |
| ⋮ | |

FIG.7B

| | |
|---|---|
| ⋮ | |
| meiyo | meiryou, meiro |
| kouryo | koukyo, kouryoku |
| ⋮ | |

FIG.7C

| | |
|---|---|
| ⋮ | |
| LEARN | MASTER, PICK UP, STUDY |
| PATTERN | DESIGN, FIGURE, MOTIF |
| ⋮ | |

| | |
|---|---|
| INPUT STATEMENT | (HOWEVER, IT IS NEEDED TO CHOOSE THE IMPLEMENTING METHOD AFTER CONSIDERING ACCESSIBILITY.) SIKASI, AKUSESIBIRITIO/KOURYOSITE, ZITUGENHOUHOUO/ SHUSHASURU/HITUYOUGAARU. |
| PHONEME STRING | SIKASI, SIKASI, AKUSE, AKUSESIBIRITIO/HAIRYO, KOURYOSITE, ZITUGENHOUHOUO/<pause>/SHUSHASURU/ HITUYOUGAARU. |

FIG.11

| CONDITION OF HEADLINE | CONDITION OF PART OF SPEECH | OPERATION |
|---|---|---|
| ⋮ | | |
| shusha | SAHEN NOUN | PAUSE<br>RESTATEMENT |
| akusesibiriti | NOUN | PAUSE<br>RESTATEMENT |
| * | CONJUNCTION | RESTATEMENT |
| ⋮ | | |

FIG.12

| | | |
|---|---|---|
| ⋮ | | |
| shusha | PAUSE AT BEGINNING OF WORD | 60% |
| | PAUSE AFTER FIRST SYLLABLE | 30% |
| | RESTATEMENT AFTER UTTERANCE | 40% |
| akusesibiriti | RESTATEMENT AFTER THIRD SYLLABLE | 70% |
| | PAUSE AFTER THIRD SYLLABLE | 30% |
| sikasinagara (CONJUNCTION) | RESTATEMENT AFTER UTTERANCE | 25% |
| | RESTATEMENT AFTER THIRD SYLLABLE | 40% |
| sikasi (CONJUNCTION) | RESTATEMENT AFTER UTTERANCE | 15% |
| | RESTATEMENT AFTER FIRST SYLLABLE | 10% |
| ⋮ | | |

FIG.14

| | |
|---|---|
| INPUT STATEMENT | (HOWEVER, IT IS NEEDED TO CHOOSE THE IMPLEMENTING METHOD AFTER CONSIDERING ACCESSIBILITY.) SIKASI, AKUSESIBIRITIO/KOURYOSITE, ZITUGENHOUHOUO/ SHUSHASURU/HITUYOUGAARU. |
| PHONEME STRING | SIKASI, AKUSE/<pause>/SIBIRITIO/KOURYOSITE, ZITUGENHOUHOUO/SHUSHA, SHUSHASURU/HITUYOUGAARU. |

FIG.16

| | |
|---|---|
| INPUT STATEMENT | (HOWEVER, IT IS NEEDED TO CHOOSE THE IMPLEMENTING METHOD AFTER CONSIDERING ACCESSIBILITY. FOR THAT, ACCESSIBILITY BECOMES IMPORTANT.) SIKASI, AKUSESIBIRITIO/KOURYOSITE, ZITUGENHOUHOUO/SHUSHASURU/HITUYOUGAARU. SONOTAME, AKUSESIBIRITINO/HYOUKAGA/JYUYOUTONARU. |
| PHONEME STRING | SIKASI, AKUSE, AKUSESIBIRITIO/KOURYOSITE, ZITUGENHOUHOUO/SHUSHA, SHUSHASURU/HITUYOUGAARU. SONOTAME, AKUSESIBIRITINO/HYOUKAGA/JYUYOUTONARU. |

FIG.17

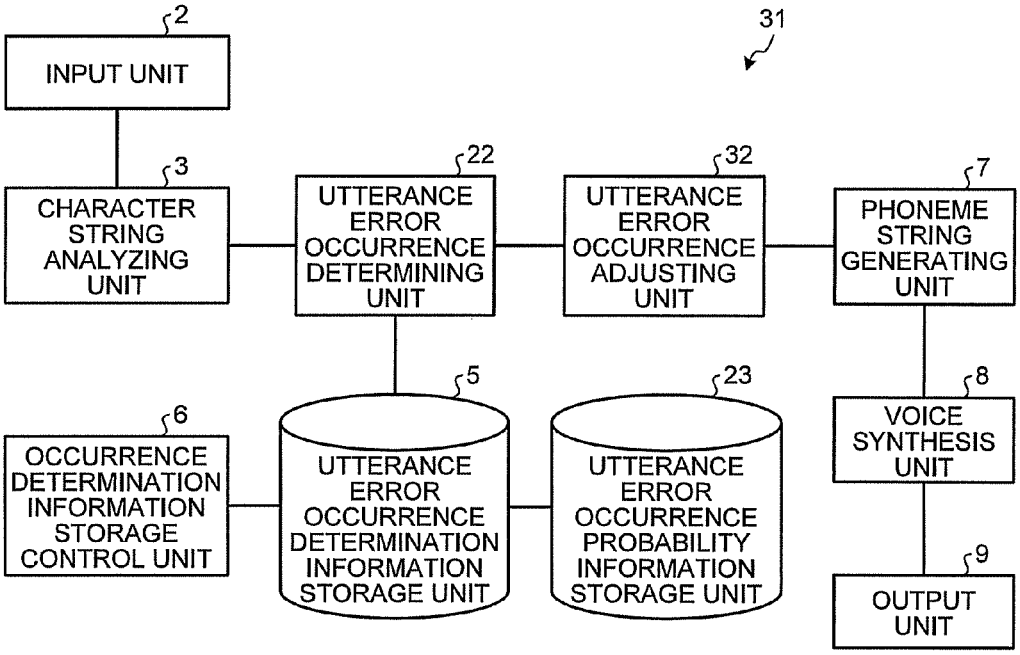

FIG.20A

| WORD | CONDITION | OPERATION |
|---|---|---|
| ⋮ | | |
| meiyo | "bankai" IS DISPOSED IMMEDIATELY AFTER "meiyo" | "meiyo" IS INCORRECTLY SPOKEN AS "omei" |
| kyokakyoku | "tokkyo" IS DISPOSED IMMEDIATELY BEFORE "kyokakyoku" | PAUSE AT BEGINNING OF WORD |
| ⋮ | | |

FIG.20B

| WORD | CONDITION | OPERATION | PRO-BABILITY |
|---|---|---|---|
| ⋮ | | | |
| meiyo | "bankai" IS DISPOSED IMMEDIATELY AFTER "meiyo" | "meiyo" IS INCORRECTLY SPOKEN AS "omei" | 90% |
| kyokakyoku | "tokkyo" IS DISPOSED IMMEDIATELY BEFORE "kyokakyoku" | PAUSE AT BEGINNING OF WORD | 75% |
| ⋮ | | | |

FIG.20C

| WORD | CONDITION | OPERATION |
|---|---|---|
| ⋮ | | |
| pickled | "a peck of" IMMEDIATELY AFTER pickled | RESTATEMENT AFTER "pick" |
| don't | "he", "she" IMMEDIATELY BEFORE doesn't | SPEECH ERROR IN "doesn't", SPEECH ERROR IS LEFT |
| ⋮ | | |

FIG.22A

| | |
|---|---|
| INPUT STATEMENT | (BECAUSE OF DISHONOR, REPUTATION IS IMPAIRED. THE IMPAIRED REPUTATION IS EXPECTED TO BE REPAIRED, IMMEDIATELY.)<br>OMEINIYOTTE, MEIYOGA/KIZUTUKERARETA.<br>ITINITIMO/HAYAKU, MEIYO/BANKAIO/KITAISURU. |
| PHONEME STRING | OMEINIYOTTE, MEIYOGA/KIZUTUKERARETA.<br>ITINITIMO/HAYAKU, OMEI, MEIYO/BANKAIO/KITAISURU. |

FIG.22B

| | |
|---|---|
| INPUT STATEMENT | TOKYOTOKKYO/KYOKAKYOKU.<br>DOUSITEMO/KYOKAKYOKUGA, UMAKU/IENAIWA. |
| PHONEME STRING | TOKYOTOKKYO/<pause>/KYOKAKYOKU.<br>DOUSITEMO/KYOKAKYOKUGA, UMAKU/IENAIWA. |

FIG.24

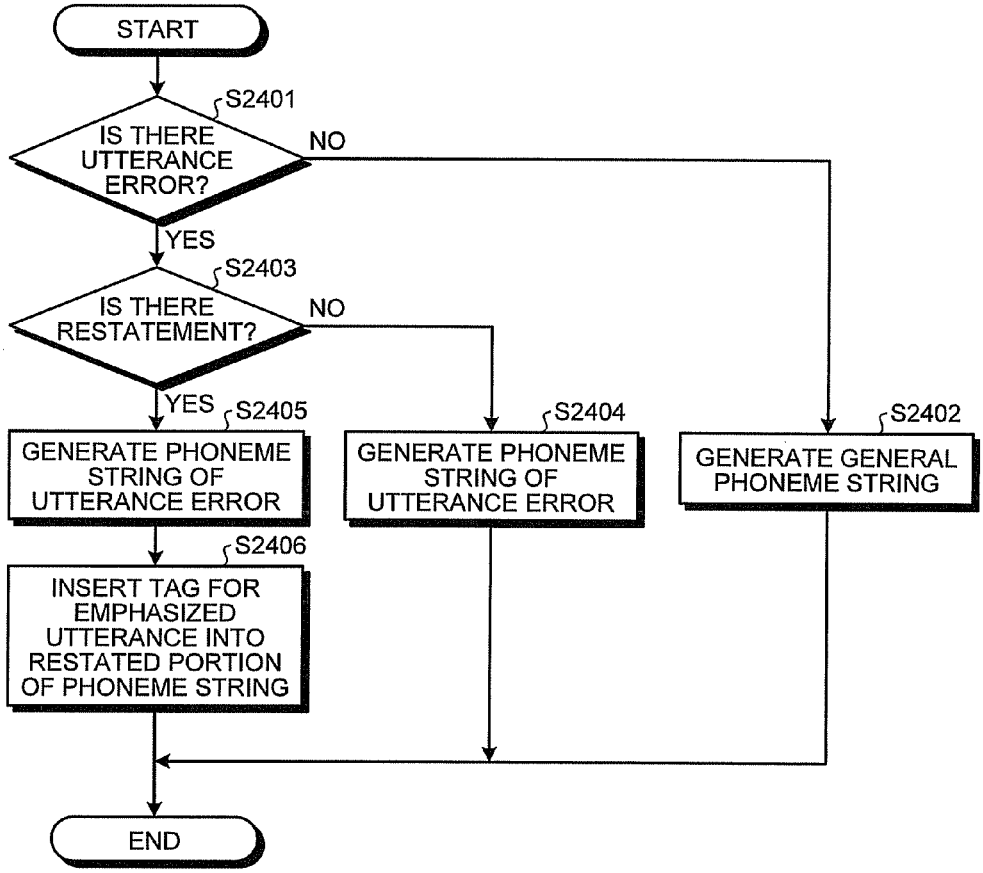

FIG.25

| | |
|---|---|
| INPUT STATEMENT | (HOWEVER, IT IS NEEDED TO CHOOSE THE IMPLEMENTING METHOD AFTER CONSIDERING ACCESSIBILITY.) SIKASI, AKUSESIBIRITIO/KOURYOSITE, ZITUGENHOUHOUO/ SHUSHASURU/HITUYOUGAARU. |
| PHONEME STRING | SIKASI, SIKASI, AKUSE, <emphasis> AKUSESIBIRITI </emphasis>O/HAIRYO, <emphasis>KOURYO</emphasis> SITE, ZITUGENHOUHOUO/<pause>/SHUSHASURU/ HITUYOUGAARU. |

SPEECH PROCESSING DEVICE, SPEECH PROCESSING METHOD, AND COMPUTER PROGRAM PRODUCT FOR SPEECH PROCESSING

CROSS-REFERENCE TO RELATED APPLICATIONS

This application is a continuation of PCT international application Ser. No. PCT/JP2009/068244 filed on Oct. 23, 2009 which designates the United States, and which claims the benefit of priority from Japanese Patent Application No. 2009-033030, filed on Feb. 16, 2009; the entire contents of which are incorporated herein by reference.

FIELD

Embodiments described herein relate generally to a speech processing device, a speech processing method, and a computer program product for speech processing.

BACKGROUND

Conventionally, there has been a voice synthesis technique that reads a given character string has been known. In the voice synthesis technique according to the related art, it is necessary to correctly read a given character string. However, in recent years, voice synthesis has been widely used. For example, the voice synthesis has been used when personal characters, such as robot pets or game characters, utter words. For example, there is disclosed a technique in which a robot pet with emotions controls the output of a synthetic sound according to the state of the emotions.

However, in many cases, it is considered that the voice read by voice synthesis is unnatural unlike a human voice. The reason why the voice is unnatural unlike a human voice is that the voice needs to be correctly read without any pause, in addition to a sound quality problem and an emotionless accent.

In order to solve the above-mentioned problems, for example, the following techniques have been proposed. Disclosed further is a voice synthesis device capable of easily generating a synthetic voice with a stammer. Also further disclosed is a voice synthesis device that inserts a silent portion with an appropriate length at a proper position between voice waveform data items to naturally synthesize a voice without incongruity. Further disclosed is a voice synthesis device capable of changing a word that is difficult to pronounce to a word that is easy to pronounce.

However, in known arts described above, it is necessary to further improve the voice synthesis technique in order to output a sound close to a human voice.

The invention has been made in view of the above-mentioned problems and an object of the invention is to provide a speech processing device, a speech processing method, and a computer program product for speech processing.

BRIEF DESCRIPTION OF THE DRAWINGS

FIG. 2A is a diagram illustrating an example of Japanese utterance error occurrence determining information stored in an utterance error occurrence determining information storage unit;

FIG. 2B is a diagram illustrating an example of English utterance error occurrence determining information stored in the utterance error occurrence determining information storage unit;

FIG. 6 is a diagram illustrating an example of utterance error occurrence determining information stored in an utterance error occurrence determining information storage unit;

FIG. 7A is a diagram illustrating an example of the related word information of Japanese that is stored in a related word information storage unit and is classified in terms of synonym;

FIG. 7B is a diagram illustrating an example of the related word information of Japanese that is stored in the related word information storage unit and is classified in terms of pronunciation;

FIG. 7C is a diagram illustrating an example of the related word information of English stored in the related word information storage unit;

FIG. 11 is a diagram illustrating an example of utterance error occurrence determining information stored in an utterance error occurrence determining information storage unit;

FIG. 12 is a diagram illustrating an example of utterance error occurrence probability information stored in an utterance error occurrence probability information storage unit;

FIG. 14 is a diagram illustrating an example of a character string input by an input unit and an actual phoneme string generated by a phoneme string generating unit;

FIG. 16 is a diagram illustrating an example of a character string input by an input unit and an actual phoneme string generated by a phoneme string generating unit;

FIG. 17 is a block diagram illustrating the structure of a speech processing device according to a fourth embodiment;

FIG. 20A is a diagram illustrating an example of Japanese context information that is stored in a context information storage unit and does not have an utterance error occurrence probability;

FIG. 20B is a diagram illustrating an example of Japanese context information that is stored in the context information storage unit and has the utterance error occurrence probability;

FIG. 20C is a diagram illustrating an example of English context information stored in the context information storage unit;

FIG. 22A is a diagram illustrating an example of a character string input by an input unit and an actual phoneme string generated by a phoneme string generating unit;

FIG. 22B is a diagram illustrating an example of a character string input by an input unit and an actual phoneme string generated by a phoneme string generating unit;

FIG. 24 is a flowchart illustrating the operation of a phoneme string generating unit; and FIG. 25 is a diagram illustrating an example of a character string input by an input unit and an actual phoneme string generated by a phoneme string generating unit.

DETAILED DESCRIPTION

In general, according to one embodiment, a speech processing device includes an utterance error occurrence determination information storage unit configured to store utterance error occurrence determination information in which error patterns are associated with conditions of a word causing an utterance error; a related word information storage unit configured to store related word information including words, which are likely to cause a speech error, for each word that causes the utterance error, the speech error being an error in which, after a wrong word is completely or partially uttered, a correct word is uttered, or the speech error being an error in which the wrong word is uttered without any correction; a character string analyzing unit configured to linguistically analyze a character string and divides the character string into word strings; an utterance error occurrence determining unit configured to compare each of the divided words with the condition, give the error pattern to the word corresponding to the condition, and determine that the word which does not correspond to the condition does not cause the utterance error; and a phoneme string generating unit configured to generate a phoneme string of the utterance error corresponding to the error pattern in the word having the error pattern given thereto and generate a general phoneme string in the word that is determined not to cause the utterance error, thereby generating a phoneme string of the word string. One of the error patterns associated with one of the conditions is the speech error, when the error pattern given to the word is the speech error, the utterance error occurrence determining unit further gives an incorrectly spoken word from the related word information, and the phoneme string generating unit generates a phoneme string of the incorrectly spoken word as the phoneme string of the utterance error corresponding to the error pattern of the word having the incorrectly spoken word given thereto.

Various embodiments of a speech processing device, a speech processing method, and a computer program product for speech processing will be described in detail with reference to the accompanying drawings.

First Embodiment

Figure 1:
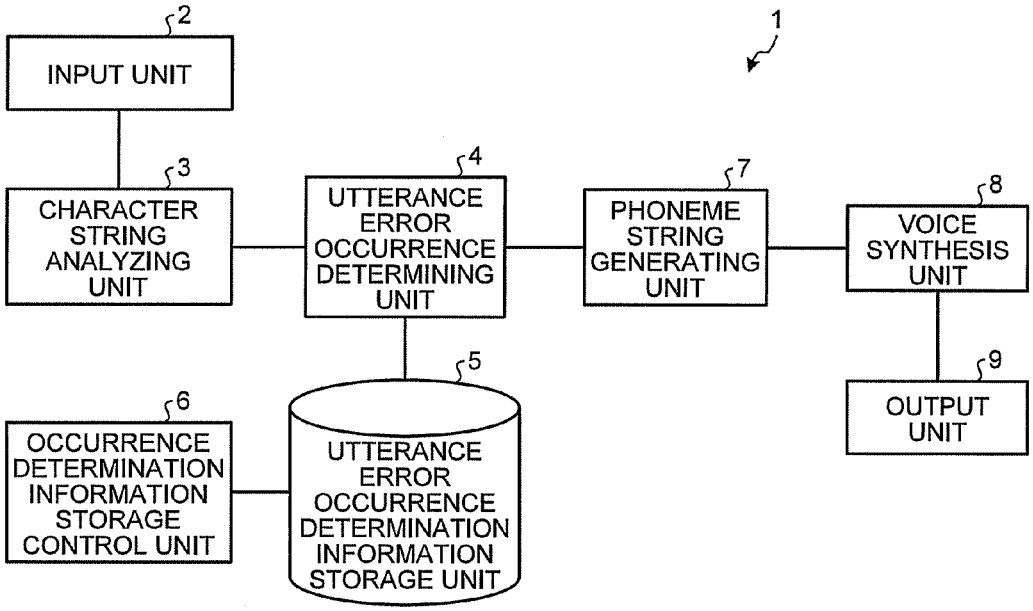
FIG. 1 is a block diagram illustrating the structure of a speech processing device according to a first embodiment.

FIG. 1 is a block diagram illustrating a structure of a speech processing device according to a first embodiment. A speech processing device 1 converts a character string that is desired to be output as a voice into voice data, which is a human voice, and outputs the voice data as an actual voice (utterance). In addition, when outputting the voice data as a voice (utterance), the speech processing device 1 intentionally generates a pause, restatement, and a speech error as utterance errors.

The "pause" means that a pause or a filler is uttered before or while words are being spoken. The term "restatement" (or "rephrase") means that, after a word is completely uttered or while the word is being uttered, the word is uttered again. The term "speech error" means that, after another word is completely uttered or while another word is being uttered, a correct word is uttered, or a wrong word is uttered without any change. The term "correct" reading means that words written in a character string are read without any correction, and reading the words in the other ways is referred to as an "utterance error." A case, in which restatement by mistake is included in a character string in advance, is not a processing target. The above is the same as that in the subsequent embodiments.

The speech processing device 1 includes an input unit 2, a character string analyzing unit 3, an utterance error occurrence determining unit 4, an utterance error occurrence determining information storage unit 5, an occurrence determination information storage control unit 6, a phoneme string generating unit 7, a voice synthesis unit 8, and an output unit 9.

The input unit 2 inputs a character string to be output as a voice and is for example a keyboard. The character string analyzing unit 3 linguistically analyzes the input character string using, for example, morphological analysis and divides the character string into word strings. The utterance error occurrence determining unit 4 determines whether an utterance error occurs in each word of the analysis result on the basis of utterance error occurrence determining information. The operation of the utterance error occurrence determining unit 4 will be described in detail below.

The utterance error occurrence determining information storage unit 5 stores the utterance error occurrence determining information, which is information used by the utterance error occurrence determining unit 4 to determine whether an utterance error occurs. FIG. 2A is a diagram illustrating an example of Japanese utterance error occurrence determining information which is stored in the utterance error occurrence determining information storage unit 5. FIG. 2B is a diagram illustrating an example of English utterance error occurrence determining information which is stored in the utterance error occurrence determining information storage unit 5. The utterance error occurrence determining information has utterance error occurrence conditions and an error pattern described therein. In this embodiment, an operation (error pattern) when an utterance error occurs is determined by the condition of a headline and the condition of parts of speech. In the drawings, a symbol "*" is a wild card and means that an utterance error occurs in all conjunctions.

The occurrence determination information storage control unit 6 controls the utterance error occurrence determining information storage unit 5 to store the utterance error occurrence determining information therein. The phoneme string generating unit 7 generates a phoneme string for an utterance error or a correct utterance using the information determined by the utterance error occurrence determining unit 4. The voice synthesis unit 8 converts the generated phoneme string into voice data. The output unit 9 outputs the voice data as a voice and is, for example, a speaker.

First, the outline of the voice processing structure of the speech processing device 1 will be described. First, the character string input by the input unit 2 is linguistically analyzed by the character string analyzing unit 3 and is then divided into words. At that time, the part of speech or the reading of each word is given. Then, the utterance error occurrence determining unit 4 determines whether each word of the word string obtained by the character string analyzing unit 3 causes an utterance error on the basis of the utterance error occurrence determining information. When it is determined that the word causes the utterance error, the utterance error occurrence determining unit 4 determines the pattern of the utterance error.

Then, when it is determined that the word causes the utterance error, the phoneme string generating unit 7 generates a phoneme string of the utterance error corresponding to the determined error pattern on the basis of the determination result of the utterance error occurrence determining unit 4. When it is determined that the word does not cause the utterance error, the phoneme string generating unit 7 generates a correct phoneme string on the basis of the determination result. Then, the voice synthesis unit 8 converts the phoneme string generated by the phoneme string generating unit 7 into voice waveform data and transmits the data to the output unit 9. Finally, the output unit 9 outputs the voice waveform as a voice. In this way, voice processing ends.

Operation of Utterance Error Occurrence Determining Unit

Figure 3:
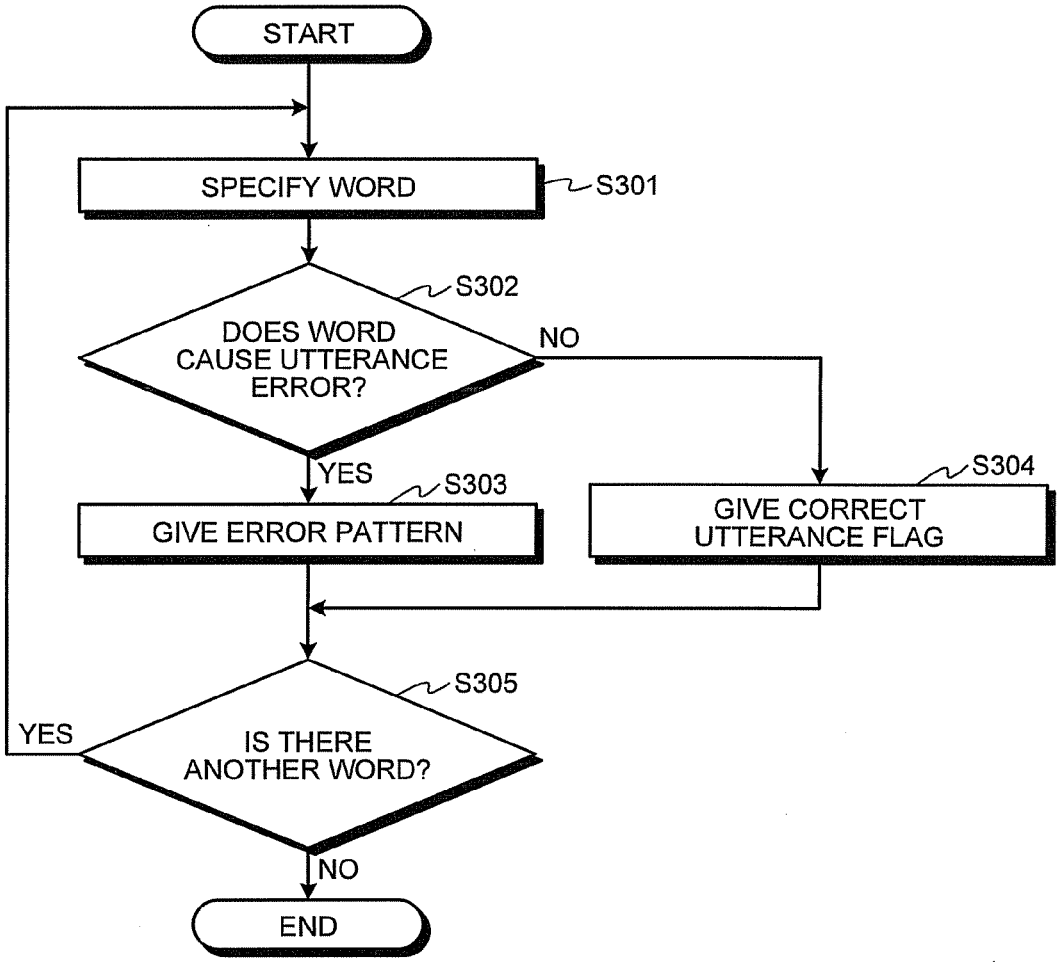
FIG. 3 is a flowchart illustrating the operation of an utterance error occurrence determining unit.

Next, the operation of the utterance error occurrence determining unit 4 will be described in detail. FIG. 3 is a flowchart illustrating the operation of the utterance error occurrence determining unit 4. First, the utterance error occurrence determining unit 4 specifies the first word of the word string that is analyzed and divided by the character string analyzing unit 3 (Step S301). Then, the utterance error occurrence determining unit 4 determines whether the word causes an utterance error (Step S302). Specifically, the utterance error occurrence determining unit 4 determines whether the word corresponds to an utterance error occurrence condition in the utterance error occurrence determining information with reference to all of the utterance error occurrence determining information stored in the utterance error occurrence determining information storage unit 5.

When it is determined that the word causes the utterance error (Step S302: Yes), the utterance error occurrence determining unit 4 gives a corresponding error pattern of the utterance error occurrence determining information to the word (Step S303). When it is determined that the word does not cause the utterance error (Step S302: No), the utterance error occurrence determining unit 4 gives information indicating that the word does not cause the utterance error to the word (Step S304). For example, the utterance error occurrence determining unit 4 gives a correct utterance flag to the word (Step S304).

Then, the utterance error occurrence determining unit 4 checks whether there is another word in the word string (Step S305). When it is checked that there is another word in the word string (Step S305: Yes), the utterance error occurrence determining unit 4 returns to Step S301 to specify the word and repeatedly performs the subsequent steps. When it is checked that there is no another word in the word string (Step S305: No), the utterance error occurrence determining unit 4 ends the process.

Then, when each word in an input statement (word string) causes an utterance error, the phoneme string generating unit 7 generates a phoneme string of the utterance error corresponding to the determined error pattern on the basis of the determination result of the utterance error occurrence determining unit 4. When each word does not cause an utterance error, the phoneme string generating unit 7 generates a correct phoneme string on the basis of the determination result.

Figures 4, 5:
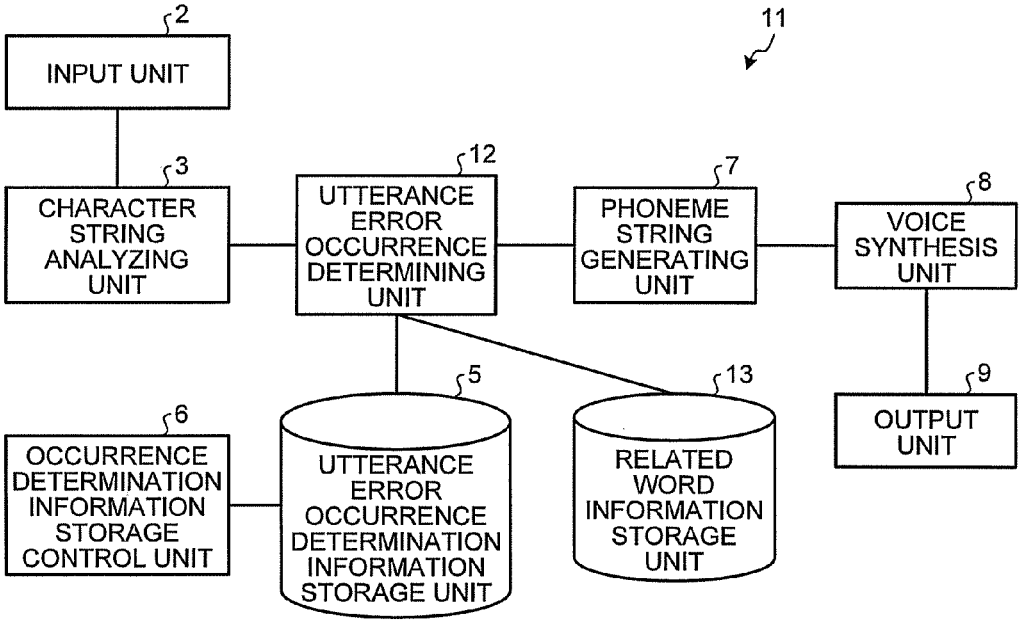
FIG. 4 is a diagram illustrating an example of a character string input by an input unit and an actual phoneme string generated by a phoneme string generating unit.
FIG. 5 is a block diagram illustrating the structure of a speech processing device according to a second embodiment.

FIG. 4 is a diagram illustrating an example of the character string input by the input unit 2 and the actual phoneme string generated by the phoneme string generating unit 7. As can be seen from FIG. 4, as in the content of the utterance error occurrence determining information shown in FIG. 2A, phoneme strings are created such that a conjunction "sikasi" is restated after utterance, a noun "akusesibiriti" is restated after a third syllable, and a noun "shusha" is paused at the beginning of the string.

As such, according to the speech processing device of the first embodiment, when the utterance error occurrence determining unit determines that the word divided from the character string causes the utterance error on the basis of the utterance error occurrence determining information, which is information for determining whether the word causes the utterance error, the phoneme string generating unit can non-uniformly generate a phoneme string of the utterance error, without generating the phoneme string as it is described in the character string. Therefore, the voice synthesis unit can intentionally synthesize a wrong voice in a non-uniform way and the output unit 9 can output a human voice, not a mechanical voice.

Second Embodiment

In a second embodiment, when an utterance error is a speech error, an incorrectly spoken word is determined with reference to related word information, which is a group of the words that are likely to cause the speech error. The second embodiment will be described below with reference to the accompanying drawings. The difference between the structure of a speech processing device according to this embodiment and the structure of the speech processing device according to the first embodiment will be described. The same components as those in the first embodiment are denoted by the same reference numerals and a description thereof will not be repeated.

FIG. 5 is a block diagram illustrating the structure of the speech processing device according to the second embodiment. A speech processing device 11 converts a character string that is desired to be output as a voice into voice data, which is a human voice, and outputs the voice data as an actual voice. In addition, when outputting the voice data as a voice (utterance), the speech processing device 11 intentionally generates a pause, restatement, and a speech error as utterance errors. The speech processing device 11 includes an input unit 2, a character string analyzing unit 3, an utterance error occurrence determining unit 12, an utterance error occurrence determining information storage unit 5, an occurrence determination information storage control unit 6, a related word information storage unit 13, a phoneme string generating unit 7, a voice synthesis unit 8, and an output unit 9.

The utterance error occurrence determining unit 12 determines whether each word of the analysis result causes an utterance error on the basis of utterance error occurrence determining information. In addition, when the utterance error is a "speech error", the utterance error occurrence determining unit 12 searches for the related word information and determines an incorrectly spoken word. FIG. 6 is a diagram illustrating an example of the utterance error occurrence determining information stored in the utterance error occurrence determining information storage unit 5. In this example, in addition to the utterance error occurrence determining information described in the first embodiment, a speech error is added as the error pattern and an incorrectly spoken word is selected at random. The operation of the utterance error occurrence determining unit 12 will be described in detail below.

When the utterance error is a "speech error", the related word information storage unit 13 arranges the words that are likely to actually cause the speech error and stores the related word information indicating the kind of speech error. FIG. 7A is a diagram illustrating an example of the related word information of Japanese which is stored in the related word information storage unit 13, in which words that are similar or opposite to an input word in meaning are classified (grouped) in terms of synonym. FIG. 7B is a diagram illustrating an example of the related word information of Japanese which is stored in the related word information storage unit 13, the words that are pronounced like an input word and are likely to be incorrectly understood or the words whose pronunciation is partially reversed to that of the input word are grouped in term of pronunciation. These information items may be arranged into one related word information item. In addition, the same information as described above may be obtained from languages other than Japanese. FIG. 7C is a diagram illustrating an example of the related word information of English which is stored in the related word information storage unit 13.

Operation of Utterance Error Occurrence Determining Unit

Figure 8:
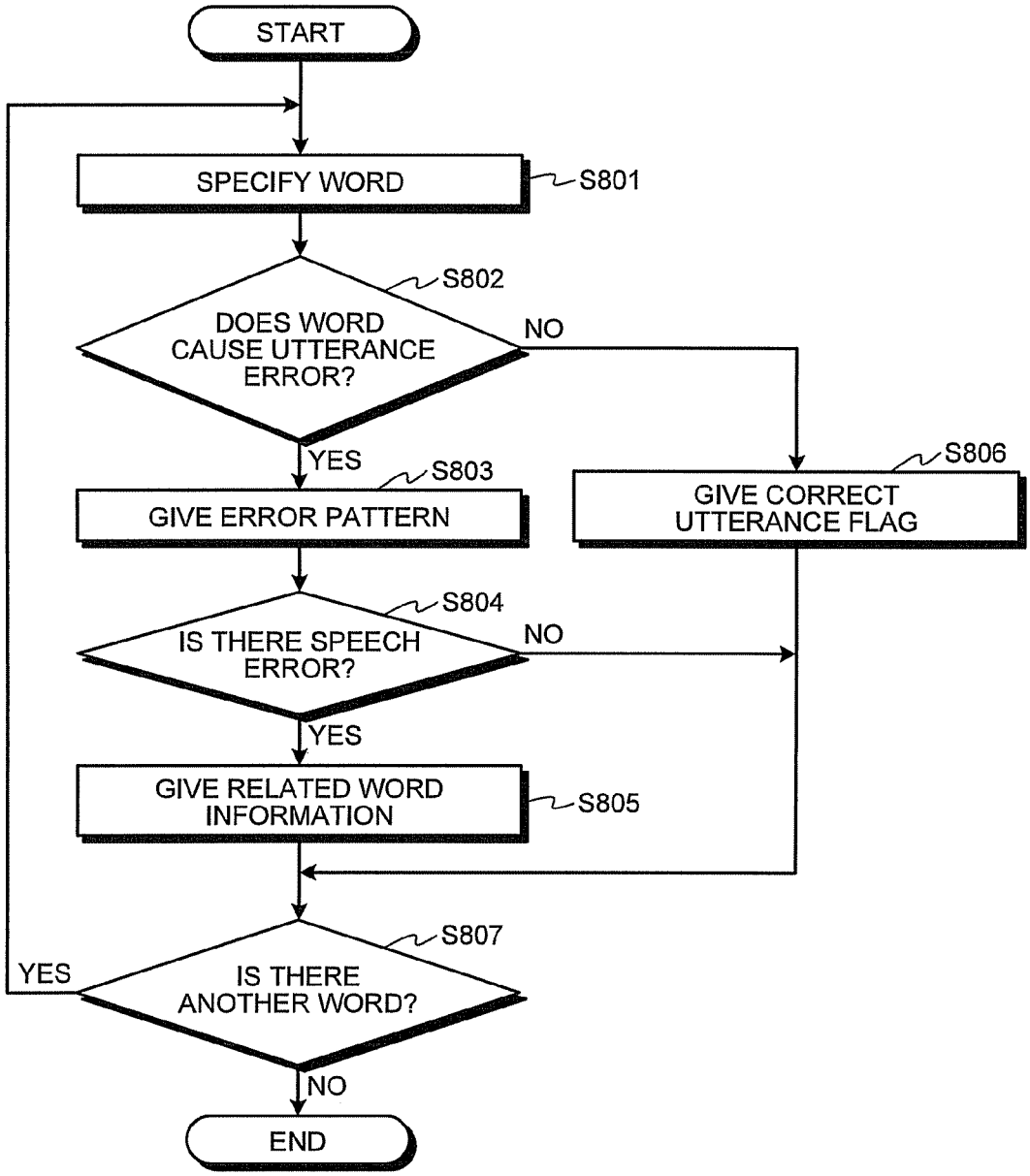
FIG. 8 is a flowchart illustrating the operation of an utterance error occurrence determining unit.

Next, the operation of the utterance error occurrence determining unit 12 will be described in detail. FIG. 8 is a flowchart illustrating the operation of the utterance error occurrence determining unit 12. First, the utterance error occurrence determining unit 12 specifies the first word in the word string that is analyzed and divided by the character string analyzing unit 3 (Step S801). Then, the utterance error occurrence determining unit 12 determines whether the word causes an utterance error (Step S802). Specifically, the utterance error occurrence determining unit 12 checks whether the word corresponds to an utterance error occurrence condition in the utterance error occurrence determining information with reference to all of the utterance error occurrence determining information stored in the utterance error occurrence determining information storage unit 5.

When it is determined that the word causes the utterance error (Step S802: Yes), the utterance error occurrence determining unit 12 gives a corresponding error pattern of the utterance error occurrence determining information to the word (Step S803).

Then, the utterance error occurrence determining unit 12 checks whether the error pattern (utterance error) is a "speech error" (Step S804). When it is determined that the error pattern is the "speech error" (Step S804: Yes), the utterance error occurrence determining unit 12 gives the related word information to the word (Step S805). Specifically, the utterance error occurrence determining unit 12 searches for the related word information of the word stored in the related word information storage unit 13 and determines an incorrectly spoken word according to a selection method which is described in the utterance error occurrence determining information of the word. Then, the utterance error occurrence determining unit 12 proceeds to Step S807.

When it is checked that the error pattern is not the "speech error" (Step S804: No), the utterance error occurrence determining unit 12 directly proceeds to Step S807.

On the other hand, when it is determined that the word does not cause the utterance error (Step S802: No), the utterance error occurrence determining unit 12 gives information indicating that the word does not cause the utterance error to the word (Step S806). For example, the utterance error occurrence determining unit 12 gives a correct utterance flag to the word. Then, the utterance error occurrence determining unit 12 proceeds to Step S807.

Then, in Step S807, the utterance error occurrence determining unit 12 checks whether there is another word in the word string. When it is checked that there is another word in the word string (Step S807: Yes), the utterance error occurrence determining unit 12 returns to Step S801 to specify the word and repeatedly performs the subsequent steps. When it is checked that there is no another word in the word string (Step S807: No), the utterance error occurrence determining unit 12 ends the process.

Then, when each word of the input statement (word string) causes the utterance error, the phoneme string generating unit 7 generates a phoneme string of the utterance error corresponding to the determined error pattern on the basis of the determination result of the utterance error occurrence determining unit 12. When each word does not cause the utterance error, the phoneme string generating unit 7 generates a correct phoneme string on the basis of the determination result.

Figures 9, 10:
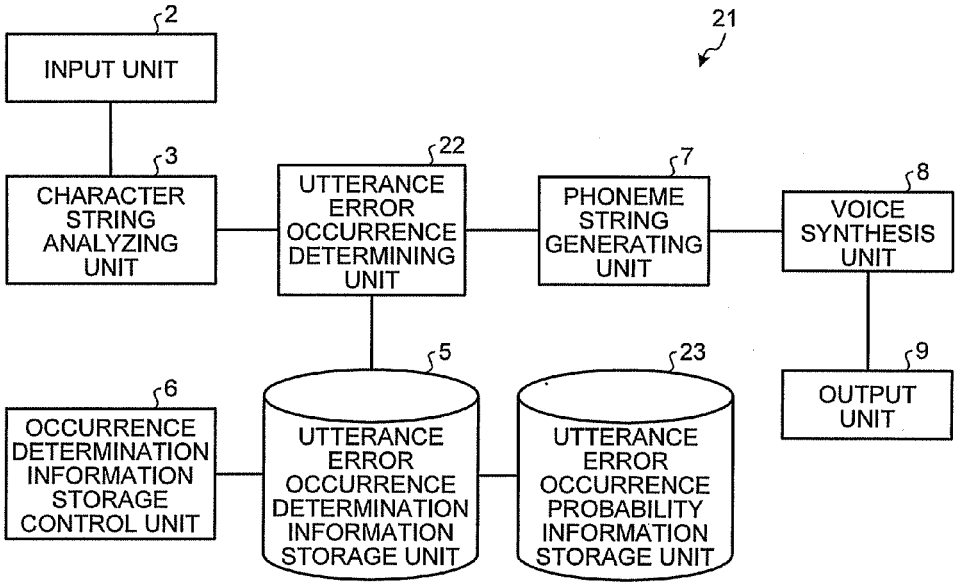
FIG. 9 is a diagram illustrating an example of a character string input by an input unit and an actual phoneme string generated by a phoneme string generating unit.
FIG. 10 is a diagram illustrating the structure of a speech processing device according to a third embodiment.

FIG. 9 is a diagram illustrating an example of the character string input by the input unit 2 and the actual phoneme string generated by the phoneme string generating unit 7. As can be seen from FIG. 9, in addition to FIG. 4 in the first embodiment, a phoneme string is generated such that a noun "kouryo" is incorrectly spoken as "hairyo" which is selected from the related word information storage shown in FIG. 7A at random and then "kouryo" is correctly spoken.

As such, according to the speech processing device of the second embodiment, when the utterance error is a speech error and it is determined that the word causes the speech error, the utterance error occurrence determining unit 12 can determine an incorrectly spoken word from the word with reference to the related word information, which is a group of the words that are likely to cause the speech error; and the phoneme string generating unit can generate a phoneme string of the speech error. Therefore, words can be incorrectly spoken using the words that do not appear in the character string, but are related to the character string and thus an utterance error can be made intelligently.

Third Embodiment

In a third embodiment, an utterance error occurrence determining unit determines whether an utterance error occurs on the basis of utterance error occurrence determining information and utterance error occurrence probability. The third embodiment will be described below with reference to the accompanying drawings. The difference between the structure of a speech processing device according to this embodiment and the structure of the speech processing device according to the first embodiment will be described. The same components as those in the first embodiment are denoted by the same reference numerals and a description thereof will not be repeated.

FIG. 10 is a block diagram illustrating the structure of the speech processing device according to the third embodiment. A speech processing device 21 converts a character string that is desired to be output as a voice into voice data, which is a human voice, and outputs the voice data as an actual voice. When outputting the voice data as a voice (utterance), the speech processing device 21 intentionally generates a pause, restatement, and a speech error as utterance errors. The speech processing device 21 includes an input unit 2, a character string analyzing unit 3, an utterance error occurrence determining unit 22, an utterance error occurrence determining information storage unit 5, an occurrence determination information storage control unit 6, an utterance error occurrence probability information storage unit 23, a phoneme string generating unit 7, a voice synthesis unit 8, and an output unit 9.

The utterance error occurrence determining unit 22 determines whether each word of the analysis result is likely to cause the utterance error on the basis of utterance error occurrence determining information. In addition, when it is determined that each word is likely to cause the utterance error, the utterance error occurrence determining unit 22 calculates the probability of the utterance error occurring and compares the probability with utterance error occurrence probability information to determine whether the word causes the utterance error. FIG. 11 is a diagram illustrating an example of the utterance error occurrence determining information stored in the utterance error occurrence determining information storage unit 5. In this example, there is a plurality of operations (error patterns) when the utterance error occurs, as compared to the utterance error occurrence determining information described in the first embodiment. The operation of the utterance error occurrence determining unit 22 will be described in detail below.

The utterance error occurrence probability information storage unit 23 stores the utterance error occurrence probability information including the probability of the utterance error occurring. FIG. 12 is a diagram illustrating an example of the utterance error occurrence probability information stored in the utterance error occurrence probability information storage unit 23. The probability of the utterance error occurring in each word is determined for each error pattern in advance by, for example, the degree of difficulty of the word or difficulty in utterance during reading. Words having a plurality of error patterns are associated with occurrence probability. For example, in FIG. 12, for a word "shusha," the probability that a pause occurs at the beginning of the word is 60%; the probability that a pause occurs after the first syllable is 30%; and the probability that the word is restated after being spoken is 40%.

The occurrence probabilities are independently evaluated and are used to determine whether the utterance error occurs. That is, the utterance error occurrence determining unit 22 calculates the probability of the utterance error occurring for each error pattern and compares the probability with the utterance error occurrence probability information of each error pattern. Therefore, in some cases, even when the occurrence probability is high, it is determined that the pattern error does not occur. In some cases, even when the occurrence probability is low, it is determined that the pattern error occurs.

Operation of Utterance Error Occurrence Determining Unit

Figure 13:
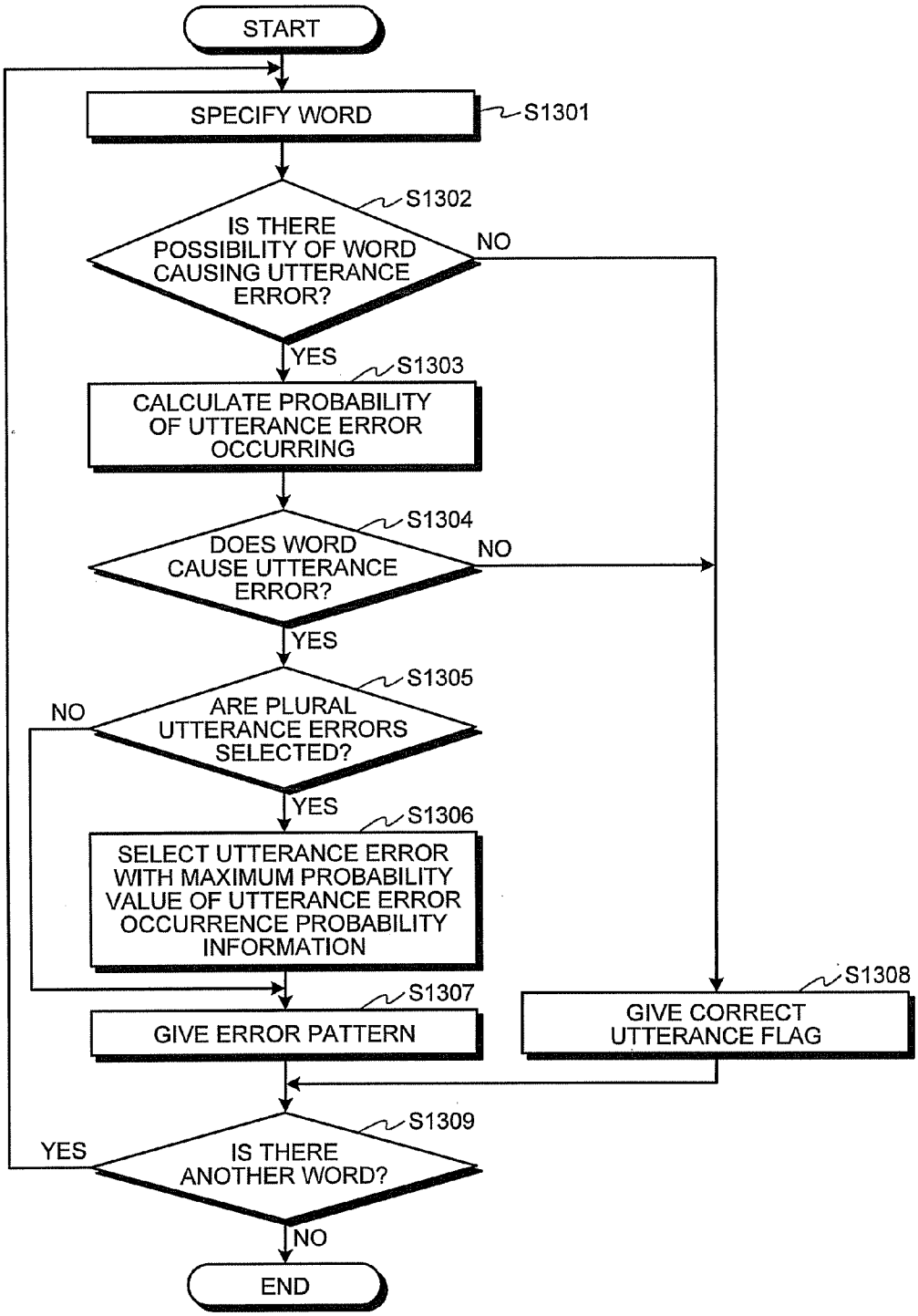
FIG. 13 is a flowchart illustrating the operation of an utterance error occurrence determining unit.

Next, the operation of the utterance error occurrence determining unit 22 will be described in detail. FIG. 13 is a flowchart illustrating the operation of the utterance error occurrence determining unit 22. First, the utterance error occurrence determining unit 22 specifies the first word of the word string that is analyzed and divided by the character string analyzing unit 3 (Step S1301). Then, the utterance error occurrence determining unit 22 determines whether the word is likely to cause an utterance error (Step S1302). Specifically, the utterance error occurrence determining unit 22 determines whether the word corresponds to an utterance error occurrence condition in the utterance error occurrence determining information with reference to all of the utterance error occurrence determining information stored in the utterance error occurrence determining information storage unit 5.

When it is determined that the word is likely to cause the utterance error (Step S1302: Yes), the utterance error occurrence determining unit 22 calculates the probability of the utterance error occurring, that is, a determination value for determining whether or not the word causes the utterance error (Step S1303). Specifically, the utterance error occurrence determining unit 22 selects one from values 0 to 99 which are generated at random and uses the value as the probability of the utterance error occurring.

Then, the utterance error occurrence determining unit 22 determines whether the word causes the utterance error (Step S1304). Specifically, the utterance error occurrence determining unit 22 determines whether the word causes the utterance error on the basis of whether the value of the probability of the utterance error occurring which is calculated in Step S1303 is less than the probability value in the utterance error occurrence probability information of the word which is stored in the utterance error occurrence probability information storage unit 23.

When it is determined that the word causes the utterance error (Step S1304: Yes), that is, when the value of the probability of the utterance error occurring which is calculated in Step S1303 is less than the probability value in the utterance error occurrence probability information of the word, the utterance error occurrence determining unit 22 proceeds to Step S1305.

When it is determined that the word does not cause the utterance error (Step S1304: No), that is, when the value of the probability of the utterance error occurring which is calculated in Step S1303 is more than the probability value in the utterance error occurrence probability information of the word, the utterance error occurrence determining unit 22 gives information indicating that the word does not cause the utterance error to the word (Step S1308). For example, the utterance error occurrence determining unit 22 gives a correct utterance flag to the word. Then, the utterance error occurrence determining unit 22 proceeds to Step S1309.

As described above, for the words having a plurality of error patterns stored in the utterance error occurrence probability information storage unit 23, Step S1303 and Step S1304 are performed for each error pattern. Therefore, only when it is determined that the utterance error does not occur for all of the error patterns, and then the process proceeds to Step S1308.

In Step S1305, the utterance error occurrence determining unit 22 checks whether a plurality of utterance errors (error patterns) are selected. When it is checked that a plurality of utterance errors are selected (Step S1305: Yes), the utterance error occurrence determining unit 22 selects an error pattern with the maximum probability value in the utterance error occurrence probability information (Step S1306) and gives the selected error pattern to the word (Step S1307). For example, in the word "shusha" shown in FIG. 12, when a pause after the first syllable (probability value: 30%) and restatement after utterance (probability value: 40%) are selected, the restatement after utterance with a higher probability value is selected. Then, the process proceeds to Step S1309.

When it is checked that a plurality of utterance errors are not selected (Step S1305: No), the utterance error occurrence determining unit 22 gives the selected error pattern to the word (Step S1307). Then, the process proceeds to Step S1309.

On the other hand, when it is determined in Step S1302 that there is no possibility of the word causing the utterance error (Step S1302: No), the utterance error occurrence determining unit 22 gives information indicating that the word does not cause the utterance error to the word (Step S1308). For example, the utterance error occurrence determining unit 22 gives a correct utterance flag to the word. Then, the process proceeds to Step S1309.

Then, in Step S1309, the utterance error occurrence determining unit 22 checks whether there is another word in the word string. When it is checked that there is another word in the word string (Step S1309: Yes), the utterance error occurrence determining unit 22 returns to Step S1301 to specify the word and repeatedly performs the subsequent steps. When it is checked that there is no another word in the word string (Step S1309: No), the utterance error occurrence determining unit 22 ends the process.

Then, when each word of the input statement (word string) causes the utterance error, the phoneme string generating unit 7 generates a phoneme string of the utterance error corresponding to the determined error pattern on the basis of the determination result of the utterance error occurrence determining unit 22. When each word does not cause the utterance error, the phoneme string generating unit 7 generates a correct phoneme string on the basis of the determination result.

FIG. 14 is a diagram illustrating an example of the character string input by the input unit 2 and the actual phoneme string generated by the phoneme string generating unit 7. As can be seen from FIG. 14, phoneme strings are created such that a conjunction "sikasi" does not cause the utterance error; the speaking of a noun "akusesibiriti" is paused after the third syllable; and a noun "shusha" is restated after utterance.

In this embodiment, as a method of determining whether the utterance error occurs, values 0 to 99 are generated at random and the values are compared with the probability value in the utterance error occurrence probability information. However, the embodiment is not limited thereto. Any method may be used as long as the result according to the probability information can be obtained.

In this example, when a plurality of error patterns is selected, one of the plurality of error patterns is selected and causes the utterance error. However, a plurality of error patterns may be selected at the same time.

In this embodiment, for simplicity of explanation, the speech error is not described in the utterance error occurrence determining information and the utterance error occurrence probability information. However, the case of the speech error may also be combined with the second embodiment.

Modifications

Figure 15:
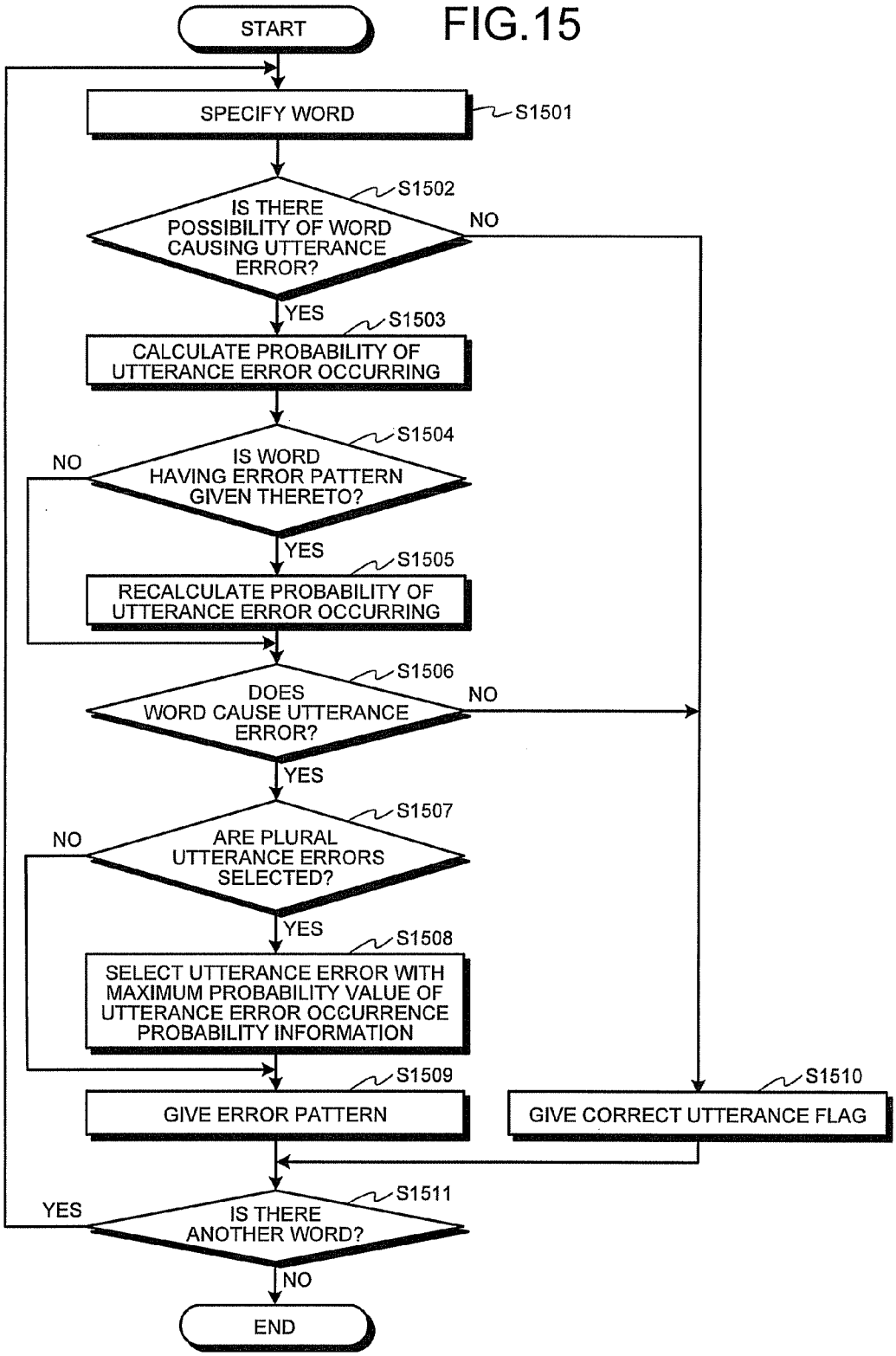
FIG. 15 is a flowchart illustrating a modification of the operation of the utterance error occurrence determining unit.

In a modification of the speech processing device according to this embodiment, when a same word as a word which has been previously determined to cause the generation error appears again in the same word string, the utterance error occurrence determining unit 22 changes a method of calculating the probability of the utterance error occurring to make the occurrence of the generation error difficult. FIG. 15 is a flowchart illustrating a modification of the operation of the utterance error occurrence determining unit 22.

First, the utterance error occurrence determining unit 22 specifies the first word of the word string that is analyzed and divided by the character string analyzing unit 3 (Step S1501). Then, the utterance error occurrence determining unit 22 determines whether there is a possibility of the word causing the utterance error (Step S1502). Specifically, the utterance error occurrence determining unit 22 checks whether the word corresponds to an utterance error occurrence condition in the utterance error occurrence determining information with reference to all of the utterance error occurrence determining information stored in the utterance error occurrence determining information storage unit 5.

When it is determined that the word is likely to cause the utterance error (Step S1502: Yes), the utterance error occurrence determining unit 22 calculates the probability of the utterance error occurring, that is, a determination value for determining whether the word causes the utterance error (Step S1503). Specifically, the utterance error occurrence determining unit 22 selects one from values 0 to 99 which are generated at random and uses the value as the probability of the utterance error occurring.

Then, the utterance error occurrence determining unit 22 checks whether the word has previously given the error pattern (Step S1504). When it is checked that the word has previously given the error pattern (Step S1504: Yes), the utterance error occurrence determining unit 22 recalculates the probability of the utterance error occurring (Step S1505). Specifically, the utterance error occurrence determining unit 22 makes the occurrence of the generation error difficult. For example, the utterance error occurrence determining unit 22 increases the probability of the utterance error occurring according to the number of times or fixes the second value to the maximum value.

On the other hand, when it is checked that the word has not previously given the error pattern (Step S1504: No), the utterance error occurrence determining unit 22 proceeds to Step S1506.

Steps S1506 to S1511 are the same as Steps S1304 to S1309 shown in FIG. 13 and thus a description thereof will not be repeated.

FIG. 16 is a diagram illustrating an example of the character string input by the input unit 2; and the actual phoneme string generated by the phoneme string generating unit 7. As can be seen from FIG. 16, the phoneme string is created such that the first noun "akusesibiriti" in the character string is restated after the third syllable; but the utterance error does not occur in the second noun "akusesibiriti."

As such, according to the speech processing device of the third embodiment, the utterance error occurrence determining unit can determine whether the utterance error occurs on the basis of the utterance error occurrence determining information, which is information for determining whether the word divided from the character string causes the utterance error and the utterance error occurrence probability, which is the probability of the word causing the utterance error. Therefore, the phoneme string generating unit does not generate a phoneme string as it is described in the character string, but can non-uniformly generate a phoneme string of the utterance error. The voice synthesis unit can intentionally and naturally synthesize a wrong voice in a non-uniform way; and the output unit can output a sound close to a human voice.

Fourth Embodiment

In a fourth embodiment, a utterance error occurrence adjusting unit adjusts the number of occurrences of an utterance error in the entire character string. The fourth embodiment will be described below with reference to the accompanying drawings. The difference between the structure of a speech processing device according to this embodiment and the structure of the speech processing device according to the third embodiment will be described below. The same components as those in the third embodiment are denoted by the same reference numerals and a description thereof will not be repeated.

FIG. 17 is a block diagram illustrating the structure of the speech processing device according to the fourth embodiment. A speech processing device 31 converts a character string that is desired to be output as a voice into voice data, which is a human voice, and outputs the voice data as an actual voice. In addition, when outputting the voice data as a voice (utterance), the speech processing device 31 intentionally generates a pause, restatement, and a speech error as utterance errors. The speech processing device 31 includes an input unit 2, a character string analyzing unit 3, an utterance error occurrence determining unit 22, an utterance error occurrence determining information storage unit 5, an occurrence determination information storage control unit 6, an utterance error occurrence probability information storage unit 23, a utterance error occurrence adjusting unit 32, a phoneme string generating unit 7, a voice synthesis unit 8, and an output unit 9.

The utterance error occurrence adjusting unit 32 adjusts the number of occurrences of the utterance error in the entire character string. Specifically, the utterance error occurrence adjusting unit 32 adjusts the number of occurrences of the utterance error on the basis of the number of occurrences of the utterance error, the number of characters between the words in which the utterance error occurs, or each condition of the utterance error occurrence probability of the words which is predetermined for the entire character string.

Operation of Utterance Error Occurrence Adjusting Unit

Figure 18:
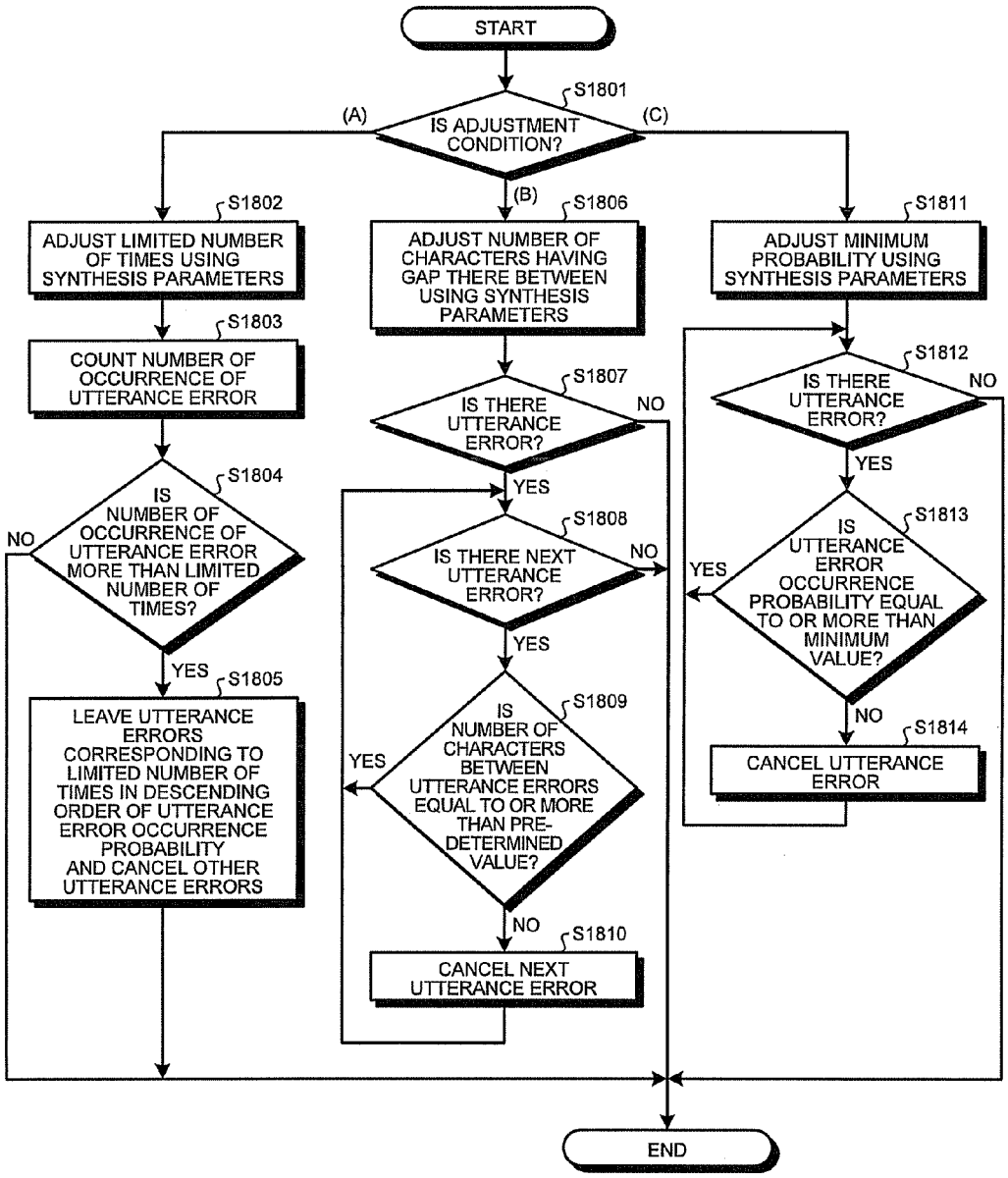
FIG. 18 is a flowchart illustrating the operation of an utterance error occurrence adjusting unit.

FIG. 18 is a flowchart illustrating the operation of the utterance error occurrence adjusting unit 32. In this embodiment, one of the following conditions in which the occurrence of the utterance error is adjusted is designated:

(A) The number of utterance errors in one character string is limited:

(B) There is a gap between the utterance errors which is equal to or more than a predetermined number of characters; and (C) Only the utterance error whose occurrence probability is equal to or more than a predetermined value occurs.

The "number of utterance errors in one character string," the "gap corresponding to a predetermined number of characters," and the "predetermined utterance error occurrence probability" vary depending on synthesis parameters, such as a speed, a speaker, and a style, when the voice synthesis unit 8 synthesizes an output voice. For example, the following relationship may be considered: a speaking speed is high=words are spoken fast=an utterance error is likely to occur. In this case, adjustment is performed as follows: the number of utterance errors in one character string increases; a gap corresponding to a predetermined number of characters is reduced; and the utterance error occurrence probability is reduced. The dependency of the adjustment on the synthesis parameters and the way the adjustment is changed are not limited in this embodiment.

First, the utterance error occurrence adjusting unit 32 performs processes corresponding to the conditions in which the occurrence of the utterance error is adjusted (Step S1801).

In the case of the condition (A) in which the number of utterance errors in one character string is limited (Step S1801: (A)), first, the utterance error occurrence adjusting unit 32 adjusts the limited number of utterance errors using the synthesis parameters (Step S1802). Then, the utterance error occurrence adjusting unit 32 counts the number of utterance errors in the entire character string (Step S1803). Then, the utterance error occurrence adjusting unit 32 checks whether the number of utterance errors is more than a limit (Step S1804).

When it is checked that the number of utterance errors is more than the limit (Step S1804: Yes), the utterance error occurrence adjusting unit 32 holds the utterance errors corresponding to the limit in the descending order of the utterance error occurrence probability and cancels the others (Step S1805). Then, the utterance error occurrence adjusting unit 32 ends the process. When the number of utterance errors is not more than the limit (Step S1804: No), the utterance error occurrence adjusting unit 32 ends the process.

In the case of the condition (B) in which the gap between the utterance errors is equal to or more than a predetermined number of characters (Step S1801: (B)), first, the utterance error occurrence adjusting unit 32 adjusts the number of characters corresponding to the gap using the synthesis parameters (Step S1806). Then, the utterance error occurrence adjusting unit 32 sequentially checks whether there is an utterance error from the head of the character string (Step S1807).

When it is checked that there is no utterance error (Step S1807: No), the utterance error occurrence adjusting unit 32 ends the process. On the other hand, when it is checked that there is an utterance error (Step S1807: Yes), the utterance error occurrence adjusting unit 32 checks whether there is next utterance error (Step S1808).

When it is checked that there is no next utterance error (Step S1808: No), the utterance error occurrence adjusting unit 32 ends the process. On the other hand, when it is checked that there is the next utterance error (Step S1808: Yes), the utterance error occurrence adjusting unit 32 checks whether the number of characters between the utterance errors is equal to or more than a predetermined value (Step S1809).

When it is checked that the number of characters between the utterance errors is less than the predetermined value (Step S1809: No), the utterance error occurrence adjusting unit 32 cancels the next utterance error (Step S1810) and returns to Step S1808. On the other hand, when it is checked that the number of characters between the utterance errors is equal to or more than the predetermined value (Step S1809: Yes), the utterance error occurrence adjusting unit 32 returns to Step S1808.

In the case of the condition (C) in which the utterance error occurrence probability of the word is equal to or more than a predetermined value (Step S1801: (C)), first, the utterance error occurrence adjusting unit 32 adjusts the minimum probability using the synthesis parameters (Step S1811). Then, the utterance error occurrence adjusting unit 32 sequentially checks whether there is an utterance error from the head of the character string (Step S1812).

When it is checked that there is no utterance error (Step S1812: No), the utterance error occurrence adjusting unit 32 ends the process. On the other hand, when it is checked that there is an utterance error (Step S1812: Yes), the utterance error occurrence adjusting unit 32 checks whether the utterance error occurrence probability of the word is equal to or more than the minimum probability (Step S1813).

When it is checked that the utterance error occurrence probability of the word is less than the minimum probability (Step S1813: No), the utterance error occurrence adjusting unit 32 cancels the utterance error of the word (Step S1814), returns to Step S1812, and checks whether there is the next utterance error. On the other hand, when it is checked that the utterance error occurrence probability of the word is equal to or more than the minimum probability (Step S1813: Yes), the utterance error occurrence adjusting unit 32 returns to Step S1812 and checks whether there is the next utterance error.

Then, when each word of the input statement (word string) causes the utterance error, the phoneme string generating unit 7 generates a phoneme string of the utterance error corresponding to the determined error pattern on the basis of the determination result of the utterance error occurrence determining unit 22 and the adjustment result of the utterance error occurrence adjusting unit 32. When each word does not cause the utterance error, the phoneme string generating unit 7 generates a correct phoneme string on the basis of the results.

In the fourth embodiment, the utterance error occurrence adjusting unit 32 has the utterance error occurrence probability of the word. However, for the conditions in which the number of utterance errors in one character string is limited or the gap between the utterance errors is equal to or more than a predetermined value, even when the utterance error occurrence probability is not used as in the first embodiment and the second embodiment, the following methods may be used: a method of selecting the utterance error at random according to the conditions; and a method of selecting only the first utterance error. In this case, it is possible to obtain the same effect as described above.

As such, according to the speech processing device of the fourth embodiment, the utterance error occurrence adjusting unit adjusts the number of occurrences of the utterance error in the entire character string. Therefore, the phoneme string generating unit can prevent the generation of a phoneme string in which unnatural utterance errors occur continuously, the voice synthesis unit can naturally synthesize a wrong voice, and the output unit can output a sound close to a human voice.

Fifth Embodiment

In a fifth embodiment, an utterance error occurrence determining unit determines whether an utterance error occurs on the basis of utterance error occurrence determining information and context information. The fifth embodiment will be described below with reference to the accompanying drawings. The difference between the structure of a speech processing device according to this embodiment and the structure of the speech processing device according to the first embodiment will be described below. The same components as those in the first embodiment are denoted by the same reference numerals and a description thereof will not be repeated.

Figure 19:
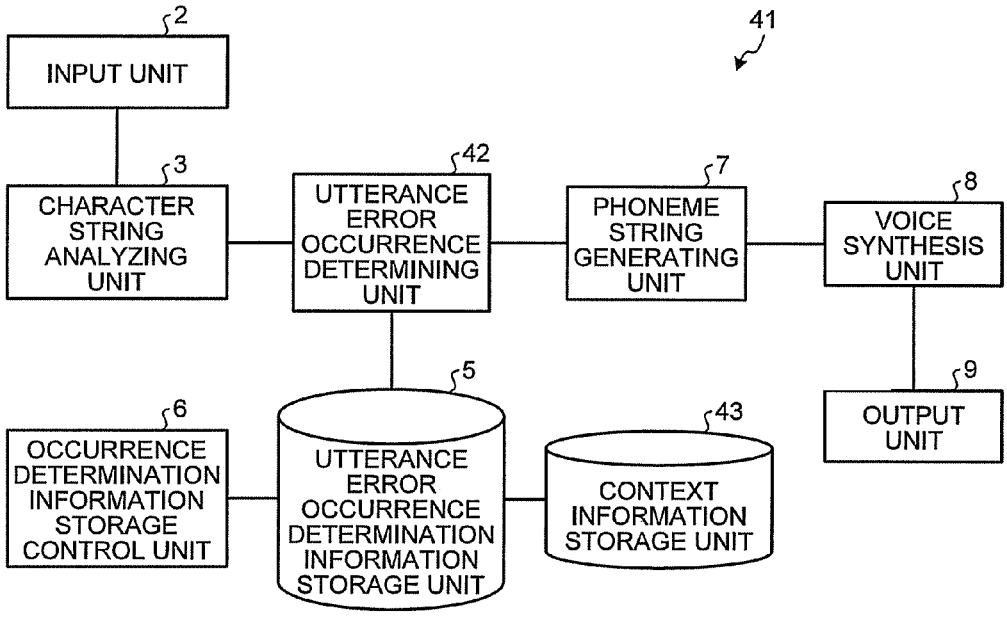
FIG. 19 is a block diagram illustrating the structure of a speech processing device according to a fifth embodiment.

FIG. 19 is a block diagram illustrating the structure of the speech processing device according to the fifth embodiment. A speech processing device 41 converts a character string that is desired to be output as a voice into voice data, which is a human voice, and outputs the voice data as an actual voice. In addition, when outputting the voice data as a voice (utterance), the speech processing device 41 intentionally generates a pause, restatement, and a speech error as utterance errors. The speech processing device 41 includes an input unit 2, a character string analyzing unit 3, an utterance error occurrence determining unit 42, an utterance error occurrence determining information storage unit 5, an occurrence determination information storage control unit 6, a context information storage unit 43, a phoneme string generating unit 7, a voice synthesis unit 8, and an output unit 9.

The utterance error occurrence determining unit 42 determines whether each word of the analysis result causes the utterance error on the basis of the utterance error occurrence determining information. In addition, when there is a possibility of the utterance error occurring, the utterance error occurrence determining unit 42 searches for the context information of the word and determines whether the word causes the utterance error. The operation of the utterance error occurrence determining unit 42 will be described in detail below.

The context information storage unit 43 stores the context information which indicates whether the utterance error occurs on the basis of, for example, the kind of words described before and after the word that is likely to cause the utterance error and indicates a detailed operation when the utterance error occurs. FIG. 20A is a diagram illustrating an example of Japanese context information stored in the context information storage unit 43 and showing an example of the structure that does not have an utterance error occurrence probability. FIG. 20B is a diagram illustrating an example of the Japanese context information stored in the context information storage unit 43 and shows an example of the structure having the utterance error occurrence probability. For example, in the case of "meiyo" shown in FIG. 20A, when the word immediately after "meiyo" is "bankai," the word "meiyo" is incorrectly spoken as "omei." In the case of "meiyo" shown in FIG. 20B, when the word immediately after "meiyo" is "bankai," the probability of the word "meiyo" being incorrectly spoken as "omei" is 90%. The embodiment is not limited to Japanese, but the same information as described above may be obtained for other languages. FIG. 20C is a diagram illustrating an example of English context information stored in the context information storage unit 43.

Operation of Utterance Error Occurrence Determining Unit

Figure 21:
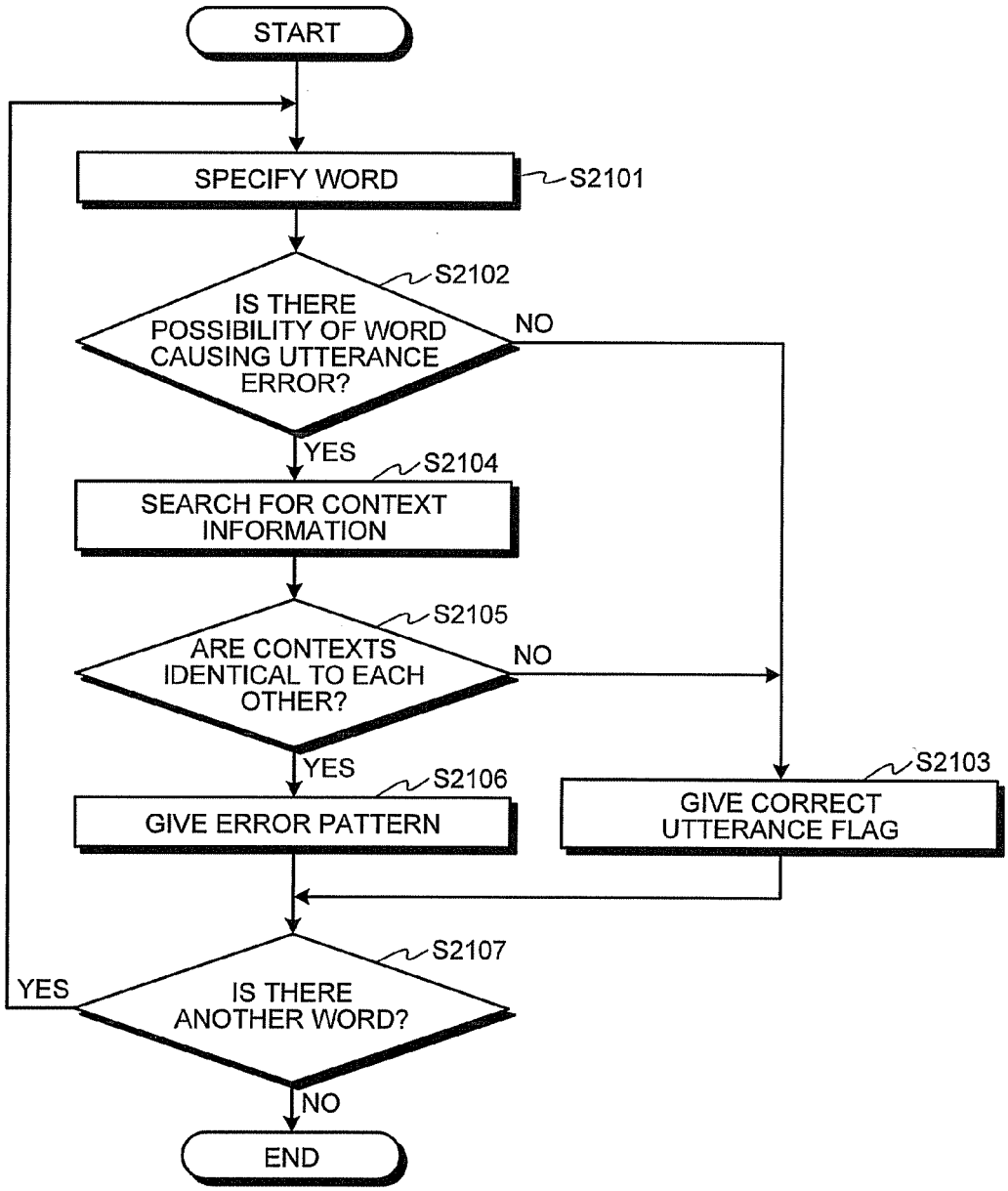
FIG. 21 is a flowchart illustrating the operation of an utterance error occurrence determining unit.

Next, the operation of the utterance error occurrence determining unit 42 will be described in detail. FIG. 21 is a flowchart illustrating the operation of the utterance error occurrence determining unit 42. First, the utterance error occurrence determining unit 42 specifies the first word of the word string which is analyzed and divided by the character string analyzing unit 3 (Step S2101). Then, the utterance error occurrence determining unit 42 determines whether there is a possibility of the word causing the utterance error (Step S2102). Specifically, the utterance error occurrence determining unit 42 checks whether the word corresponds to an utterance error occurrence condition in the utterance error occurrence determining information with reference to all of the utterance error occurrence determining information stored in the utterance error occurrence determining information storage unit 5.

When there is no possibility of the word causing the utterance error (Step S2102: No), the utterance error occurrence determining unit 42 gives information indicating that the word does not cause the utterance error to the word (Step S2103). For example, the utterance error occurrence determining unit 42 gives a correct utterance flag to the word. When there is a possibility of the word causing the utterance error (Step S2102: Yes), the utterance error occurrence determining unit 42 searches for context information corresponding the word in the context information storage unit 43 (Step S2104).

Then, the utterance error occurrence determining unit 42 checks whether the contexts are identical to each other, that is, whether the content of the context information is identical to the content of the input statement (the kinds of words described before and after the word) (Step S2105). When it is checked that the contexts are identical to each other (Step S2105: Yes), the utterance error occurrence determining unit 42 gives a corresponding error pattern of the context information to the word (Step S2106). When it is checked that the contexts are not identical to each other (Step S2105: No), the utterance error occurrence determining unit 42 gives information indicating that the word does not cause the utterance error to the word (Step S2103). For example, the utterance error occurrence determining unit 42 gives a correct utterance flag to the word.

Then, the utterance error occurrence determining unit 42 checks whether there is another word in the word string (Step S2107). When it is checked that there is another word in the word string (Step S2107: Yes), the utterance error occurrence determining unit 42 returns to Step S2101 to specify the word and repeatedly performs the subsequent steps. When it is checked that there is no another word in the word string (Step S2107: No), the utterance error occurrence determining unit 42 ends the process.

Then, when each word of the input statement (word string) causes the utterance error, the phoneme string generating unit 7 generates a phoneme string of the utterance error corresponding to the determined error pattern on the basis of the determination result of the utterance error occurrence determining unit 42. When each word does not cause the utterance error, the phoneme string generating unit 7 generates a correct phoneme string on the basis of the determination result.

FIG. 22A and FIG. 22B are diagrams illustrating an example of the character string input by the input unit 2, and the actual phoneme string generated by the phoneme string generating unit 7. A phoneme string in which "meiyo" is incorrectly spoken as "omei" as shown in FIG. 22A and a phoneme string in which "kyokakyoku" is paused as shown in FIG. 22B are created only when they satisfy the conditions of the context information.

When the generation error is a speech error, this embodiment may be combined with the second embodiment.

The structure having the utterance error occurrence probability may be combined with the third embodiment.

As such, according to the speech processing device of the fifth embodiment, the utterance error occurrence determining unit can determine whether the word divided from the character string causes the utterance error on the basis of the utterance error occurrence determining information, which is information for determining whether the word causes the utterance error, and the context information. Therefore, the phoneme string generating unit can generate a phoneme string of the utterance error only for the word that is used in a specific content even when the same word is described in the character string. The voice synthesis unit can intentionally and naturally synthesize a wrong voice in a non-uniform way and the output unit can output a sound close to the human voice.

Sixth Embodiment

In a sixth embodiment, when generating a phoneme string of restatement, a phoneme string generating unit generates a phoneme string in which the word that has been uttered is once more uttered so as to be emphasized. The sixth embodiment will be described below with reference to the accompanying drawings. The difference between the structure of a speech processing device according to this embodiment and the structure of the speech processing device according to the first embodiment will be described below. The same components as those in the first embodiment are denoted by the same reference numerals and a description thereof will not be repeated.

Figure 23:
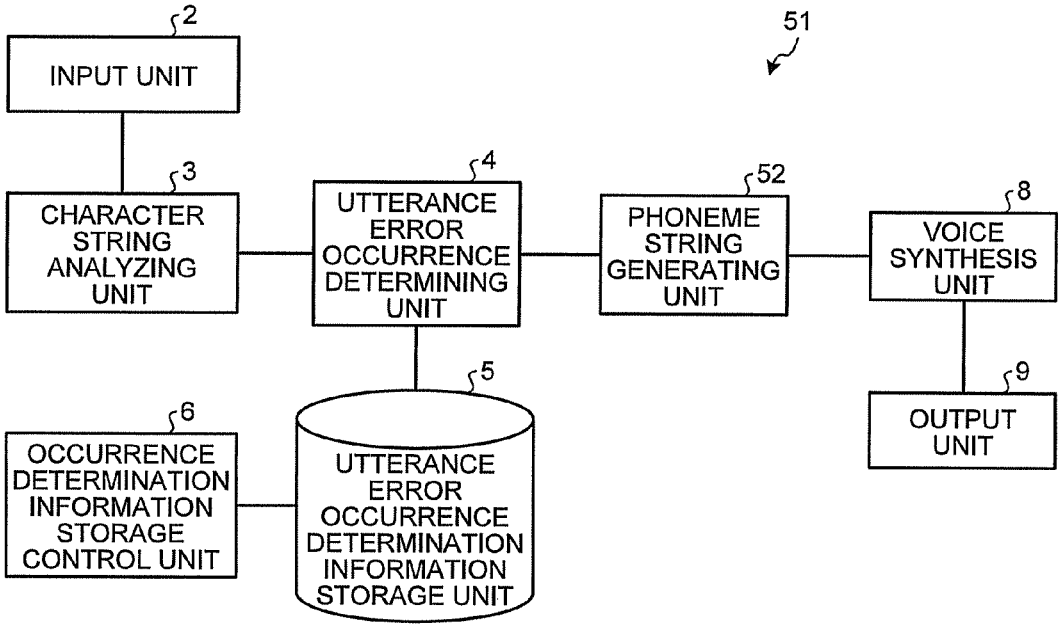
FIG. 23 is a block diagram illustrating the structure of a speech processing device according to a sixth embodiment.

FIG. 23 is a block diagram illustrating a structure of the speech processing device according to the sixth embodiment. A speech processing device 51 converts a character string that is desired to be output as a voice into voice data, which is a human voice, and outputs the voice data as an actual voice. In addition, when outputting the voice data as a voice (utterance), the speech processing device 51 intentionally generates a pause, restatement, and a speech error as utterance errors. The speech processing device 51 includes an input unit 2, a character string analyzing unit 3, an utterance error occurrence determining unit 4, an utterance error occurrence determining information storage unit 5, an occurrence determination information storage control unit 6, a phoneme string generating unit 52, a voice synthesis unit 8, and an output unit 9.

The phoneme string generating unit 52 generates a phoneme string of the utterance error or a phoneme string for correct utterance using the information determined by the utterance error occurrence determining unit 4. When the utterance error is "restatement," the phoneme string generating unit 52 inserts a tag for emphasis into the generated phoneme string of the utterance error.

Operation of Phoneme String Generating Unit

Next, the operation of the phoneme string generating unit 52 will be described. FIG. 24 is a flowchart illustrating the operation of the phoneme string generating unit 52. First, the phoneme string generating unit 52 checks whether there is an utterance error (error pattern) (Step S2401). When it is checked that there is no utterance error (Step S2401: No), the phoneme string generating unit 52 generates a general phoneme string (Step S2402) and ends the process.

When it is checked that there is an utterance error (Step S2401: Yes), the phoneme string generating unit 52 checks whether the utterance error is "restatement" (Step S2403). When it is checked that the utterance error is not "restatement" (Step S2403: No), the phoneme string generating unit 52 generates a phoneme string of the utterance error (Step S2404) and ends the process.

When it is checked that the utterance error is "restatement" (Step S2403: Yes), the phoneme string generating unit 52 generates a phoneme string of the utterance error (Step S2405). Then, the phoneme string generating unit 52 inserts a tag for emphasis into a restated portion of the phoneme string (Step S2406) and ends the process.

FIG. 25 is a diagram illustrating an example of the character string input by the input unit 2 and the actual phoneme string generated by the phoneme string generating unit 52. As can be seen from FIG. 25, emphasis tags are inserted into nouns "akusesibiriti" and "kouryo" to be restated.

In this embodiment, for simplicity of explanation, the case in which the utterance error is a speech error is not described. However, this embodiment may be similarly applied to a case in which the utterance error is a speech error and may be combined with the second embodiment.

This embodiment does not have the utterance error occurrence probability. However, this embodiment may be combined with the third embodiment and have the utterance error occurrence probability.

As such, according to the speech processing device of the sixth embodiment, when generating a phoneme string of restatement (speech error), the phoneme string generating unit can generate a phoneme string in which the word that has been uttered once more is spoken so as to be emphasized. Therefore, the output unit can output a correct word so as to be emphasized when the correct word is uttered. As a result, it is possible to clearly show that the word has been exactly corrected.

In the first to sixth embodiments, the Japanese language is mainly described. However, the embodiment is not restricted into using the Japanese language, but the same method can be applied to other languages, such as English. In this case, the same effect as described above can be obtained.

The invention is not limited to the above-described embodiments, but the components may be changed in the execution stage without departing from the scope and spirit of the invention. A plurality of components according to the above-described embodiments may be appropriately combined with each other to form various kinds of structures. For example, some of all of the components according to the above-described embodiments may be removed. In addition, the components according to different embodiments may be appropriately combined with each other.

The speech processing device according to this embodiment has a hardware structure which uses a general computer and includes a control device, such as a CPU, a storage device, such as a ROM or a RAM, an external storage device, such as an HDD or a CD drive, a display, such as a display device, an input device, such as a keyboard or a mouse, and an output device, such as a speaker or a LAN interface.

A speech processing program executed by the speech processing device according to this embodiment is recorded as a file of an installable format or an executable format on a computer-readable storage medium, such as a CD-ROM, a flexible disk (FD), a CD-R, or a DVD (Digital Versatile Disk) and is provided as a computer program product.

The speech processing program executed by the speech processing device according to this embodiment may be stored in a computer that is connected to a network, such as the Internet, may be downloaded through the network, and may be provided. In addition, the speech processing program executed by the speech processing device according to this embodiment may be provided or distributed through a network, such as the Internet.

Furthermore, the speech processing program according to this embodiment may be incorporated into, for example, a ROM in advance and then provided.

The speech processing program executed by the speech processing device according to this embodiment has a module structure including the above-mentioned units (for example, the character string analyzing unit, the utterance error occurrence determining unit, the phoneme string generating unit, the voice synthesis unit, and the utterance error occurrence adjusting unit). As the actual hardware, a CPU (processor) reads the speech processing program from the above-mentioned storage medium and executes the speech processing program. Then, the above-mentioned units are loaded to a main storage device, and the character string analyzing unit, the utterance error occurrence determining unit, the phoneme string generating unit, the voice synthesis unit, and the utterance error occurrence adjusting unit are generated on the main storage device.

According to several embodiments, it is possible to intentionally synthesize a wrong voice in a non-uniform way and to output a human-like voice, not a mechanic-like voice.

Several embodiments are capable of intentionally causing an utterance error in a character string without reading the character string as it is, thereby outputting a sound close to a human utterance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech processing device comprising:

an utterance error occurrence determination information storage unit configured to store utterance error occurrence determination information in which error patterns are associated with conditions of a word causing an utterance error;

a related word information storage unit configured to store related word information including words, which are likely to cause a speech error, for each word that causes the utterance error, the speech error being an error in which, after a wrong word is completely or partially uttered, a correct word is uttered, or the speech error being an error in which the wrong word is uttered without any correction;

a character string analyzing unit configured to linguistically analyze a character string and divides the character string into word strings;

an utterance error occurrence determining unit configured to compare each of the divided words with the conditions, give the error pattern to a word corresponding to the conditions, and determine that a word which does not correspond to the conditions does not cause the utterance error; and a phoneme string generating unit configured to generate a phoneme string of the utterance error corresponding to the error pattern in the word having the error pattern given thereto and generate a general phoneme string in the word that is determined not to cause the utterance error, thereby generating a phoneme string of the word strings, wherein one of the error patterns associated with one of the conditions is the speech error, when there is a certain word having the speech error as the error pattern, the utterance error occurrence determining unit further gives the certain word an incorrectly spoken word selected from the related word information, and the phoneme string generating unit generates, as the phoneme string of the utterance error corresponding to the error pattern of the certain word, a phoneme string including at least a part of the incorrectly spoken word and, subsequent to at least the part of the incorrectly spoken word, the certain word.

2. The device according to claim 1, wherein one of the error patterns associated with one of the conditions is a pause that occurs before or while a word is uttered.

3. The device according to claim 1, wherein one of the error patterns associated with one of the conditions is restatement in which, after a word is completely uttered or while the word is uttered, the word is uttered again.

4. The device according to claim 1, wherein the related word information is a group including words that are related to each other in terms of meaning or a group including words that are related to each other in terms of pronunciation.

5. The device according to claim 1, wherein the conditions indicate a part of speech of the word that causes the utterance error.

6. The device according to claim 1, further comprising:

an utterance error occurrence probability information storage unit configured to store utterance error occurrence probability, which is a probability of the word causing the utterance error, wherein the utterance error occurrence determining unit determines whether each word causes the utterance error, on the basis of the utterance error occurrence probability.

7. The device according to claim 6, wherein the utterance error occurrence probability depends on the frequency of use of the word causing the utterance error, the degree of difficulty in meaning, or a difficulty in utterance during reading.

8. The device according to claim 6, wherein, when the word has caused the utterance error, the utterance error occurrence determining unit determines that the word does not cause the utterance error any further.

9. The device according to claim 1, further comprising:

a context information storage unit configured to store context information indicating whether the word causes the utterance error on the basis of a kind of words described before or after the word that causes the utterance error, wherein the utterance error occurrence determining unit determines whether each word causes the utterance error on the basis of the context information.

10. The device according to claim 6, further comprising:

a context information storage unit configured to store context information indicating whether the word causes the utterance error on the basis of a kind of words described before or after the word that causes the utterance error, wherein the utterance error occurrence determining unit determines whether each word causes the utterance error on the basis of the context information.

11. The device according to claim 6, further comprising:

a utterance error occurrence adjusting unit configured to adjust the number of occurrences of the utterance error in the entire character string.

12. The device according to claim 11, wherein the utterance error occurrence adjusting unit adjusts the number of occurrences of the utterance error so as to be equal to or less than a predetermined value.

13. The device according to claim 11, wherein, when a gap between the word in which the utterance error occurs and a word in which the next utterance error occurs is less than a predetermined value, the utterance error occurrence adjusting unit adjusts the number of occurrences of the utterance error such that the next utterance error does not occur.

14. The device according to claim 11, wherein, when the utterance error occurrence probability is equal to or less than a predetermined value, the utterance error occurrence adjusting unit adjusts the number of occurrences of the utterance error such that the utterance error does not occur.

15. The device according to claim 3, wherein, when generating a phoneme string of the restatement, the phoneme string generating unit generates a phoneme string in which the word which is uttered again is emphasized.

16. The device according to claim 1, wherein, when the correct word is uttered due to the speech error after the wrong word is completely uttered or while the wrong word is uttered, the phoneme string generating unit generates a phoneme string in which the correct word is uttered so as to be emphasized.

17. The device according to claim 1, further comprising:

a voice synthesis unit configured to convert the phoneme string of the word strings into voice data.

18. A speech processing method comprising:

analyzing that includes linguistically analyzing a character string so as to divide the character string into word strings;

determining an utterance error occurrence by comparing each of the divided words with a condition of an utterance error occurrence determination information stored in an utterance error occurrence determination information storage unit, the utterance error occurrence determination information being associated with error patterns for conditions of a word causing an utterance error, giving the error pattern to a word corresponding to the conditions, and determining that a word which does not correspond to the conditions does not cause the utterance error; and generating, by a phoneme string generating unit, a phoneme string by generating a phoneme string of the utterance error corresponding to the error pattern in the word having the error pattern given thereto, generating a general phoneme string in the word that is determined not to cause the utterance error, and thereby generating a phoneme string of the word strings, wherein one of the error patterns associated with one of the conditions is a speech error, the speech error being an error in which, after a wrong word is completely or partially uttered, a correct word is uttered, or the speech error being an error in which the wrong word is uttered without any correction, at the determining the utterance error occurrence, when there is a certain word having the speech error as the error pattern, an incorrectly spoken word selected from related word information is further given to the certain word, the related word information being stored in a related word information storage unit that stores the related word information including words, which are likely to cause the speech error, for each word that causes the utterance error, and at the generating, as the phoneme string of the utterance error corresponding to the error pattern of the certain word, a phoneme string including at least a part of the incorrectly spoken word and, subsequent to at least the part of the incorrectly spoken word, the certain word.

19. A computer program product for speech processing having a non-transitory computer readable medium including programmed instructions, wherein the instructions, when executed by a computer, cause the computer to perform:

analyzing that includes linguistically analyzing a character string so as to divide the character string into word strings;

determining an utterance error occurrence by comparing each of the divided words with a condition of an utterance error occurrence determination information stored in an utterance error occurrence determination information storage unit, the utterance error occurrence determination information being associated with error patterns for conditions of a word causing an utterance error, giving the error pattern to a word corresponding to the conditions, and determining that a word which does not correspond to the conditions does not cause the utterance error; and generating a phoneme string by generating a phoneme string of the utterance error corresponding to the error pattern in the word having the error pattern given thereto, generating a general phoneme string in the word that is determined not to cause the utterance error, and thereby generating a phoneme string of the word strings, wherein one of the error patterns associated with one of the conditions is a speech error, the speech error being an error in which, after a wrong word is completely or partially uttered, a correct word is uttered, or the speech error being an error in which the wrong word is uttered without any correction, at the determining the utterance error occurrence, when there is a certain word having the speech error as the error pattern, an incorrectly spoken word selected from related word information is further given to the certain word, the related word information being stored in a related word information storage unit that stores the related word information including words, which are likely to cause the speech error, for each word that causes the utterance error, and at the generating, as the phoneme string of the utterance error corresponding to the error pattern of the certain word, a phoneme string including at least a part of the incorrectly spoken word and, subsequent to at least the part of the incorrectly spoken word, the certain word.

* * * * *